United States Patent [19]

McLaen et al.

[11] 4,346,154

[45] Aug. 24, 1982

[54] ANTISTAIN AGENT OR ANTISTAIN AGENT PRECURSOR IN PHOTOGRAPHIC SILVER HALIDE ELEMENT

[75] Inventors: Donald F. McLaen; Arthur H. Herz, both of Rochester, N.Y.

[73] Assignee: Eastman Kodak Company, Rochester, N.Y.

[21] Appl. No.: 276,330

[22] Filed: Jun. 22, 1981

[51] Int. Cl.[3] ..... G03C 1/06; G03C 1/48

[52] U.S. Cl. ..... 430/14; 430/405; 430/428; 430/448; 430/495; 430/539; 430/566; 430/610; 430/955

[58] Field of Search ..... 430/601, 610, 372, 405, 430/403, 448, 566, 428, 523, 539, 551, 955, 11, 14, 495

[56] References Cited

U.S. PATENT DOCUMENTS

| | | | |
|---|---|---|---|
| 3,578,449 | 5/1971 | Bloom et al. | 96/29 |
| 3,640,713 | 2/1972 | Buckler et al. | 96/29 |
| 3,904,415 | 9/1975 | Oftedahl | 430/601 |
| 4,138,256 | 2/1979 | Chylewski et al. | 96/53 |

FOREIGN PATENT DOCUMENTS

| | | | |
|---|---|---|---|
| 1066261 | 4/1967 | United Kingdom . | |
| 1258906 | 12/1971 | United Kingdom . | |
| 1430998 | 4/1976 | United Kingdom . | |
| 195872 | 7/1967 | U.S.S.R. | 430/601 |
| 249938 | 12/1969 | U.S.S.R. | 430/610 |

*Primary Examiner*—Mary F. Downey

*Attorney, Agent, or Firm*—Richard E. Knapp

[57] ABSTRACT

A stain retarding concentration of a phosphine antistain agent or phosphine antistain agent precursor in the undercoat layer of a photographic silver halide element comprising a support having thereon (a) a photographic silver halide gelatino emulsion layer, and (b) an undercoat layer between the emulsion layer and the support, provides reduced stain in the element upon exposure and processing. The photographic element preferably comprises a silver halide developing agent. The photographic element, after exposure, is preferably processed by means of an aqueous alkaline activator bath and then an aqueous thiosulfate stabilizer bath.

15 Claims, No Drawings

ANTISTAIN AGENT OR ANTISTAIN AGENT PRECURSOR IN PHOTOGRAPHIC SILVER HALIDE ELEMENT

BACKGROUND OF THE INVENTION

1. Field of the Invention

This invention relates to a photographic silver halide element having a photographic silver halide gelatino emulsion layer and an undercoat layer comprising a stain retarding concentration of a phosphine antistain agent or a phosphine antistain agent precursor in the undercoat layer. This invention also relates to a method of developing and stabilizing a silver image to reduce post-process buildup of silver sulfide stain in such a photographic silver halide element.

2. Description of the State of the Art

Photographic silver halide elements designed for rapid processing, especially those designed for processing in an activator bath and a silver halide thiosulfate stabilization bath, are well known. Generally, such photographic silver halide elements contain silver halide developing agents which enable more rapid development. The photographic silver halide element is useful without the need for further fixing. Such photographic elements have suitable resistance to stain formation upon short term keeping. For longer keeping purposes, a problem of undesired stain formation has been encountered in such photographic elements. No suitable answer to this stain problem is clear from the photographic art.

Many compounds have been incorporated in photographic silver halide emulsions as antifoggants. An example of such a compound is an aryl phosphine sulphonic acid or water soluble salt thereof, as described in U.K. Patent Specification No. 1,066,261. While such phosphine compounds are useful in antifoggant concentrations in silver halide gelatino emulsions, the compounds are not useful in silver halide gelatino emulsions at higher concentrations than antifoggant concentrations, because the phosphine compounds cause undesired desensitization of the silver halide prior to exposure and processing.

SUMMARY OF THE INVENTION

According to the invention, a photographic silver halide element is provided which enables reduced stain formation in the element upon exposure and processing. The photographic silver halide element comprises a support having thereon:

(a) a photographic silver halide gelatino emulsion layer, and (b) an undercoat layer between the emulsion layer and the support.

The photographic silver halide element also preferably comprises:

(c) a photographic silver halide developing agent in at least one layer of the element, preferably an undercoat layer.

The improvement comprises in the undercoat layer a stain retarding concentration of a phosphine antistain agent or phosphine antistain agent precursor. Alternatively, the photographic silver halide element comprises an undercoat layer and an overcoat layer. The phophine antistain agent or phosphine antistain agent precursor is alternatively in both the undercoat layer and the overcoat layer.

A "stain retarding concentration" herein means a concentration of phosphine antistain agent or phosphine antistain agent precursor that reduces stain in the element of the invention. Preferably, the concentration is within the range of 50 to 250 mg of the phosphine antistain agent or phosphine antistain agent precursor per square foot (about 5.4 to about 27.0 mg per square decimeter) of support.

A method of developing and stabilizing a silver image to reduce post-process buildup of stain, especially silver sulfide stain, in an exposed photographic element according to the invention comprises the steps of:

(i) activating development of the exposed element by means of an aqueous alkaline activator solution until a developed silver image is produced; and then (ii) stabilizing the resulting image by means of an aqueous thiosulfate stabilizer solution comprising a silver halide stabilizing concentration of a thiosulfate stabilizing agent.

The location of the phosphine antistain agent or the phosphine antistain agent precursor in the undercoat layer, or alternatively in the undercoat layer and an overcoat layer, enables the desired reduced stain in the element, as well as avoiding undesired desensitization of the photographic silver halide. Also, sufficient phosphine antistain agent remains in the element after exposure and processing of the element to help reduce stain formation.

DETAILED DESCRIPTION OF THE INVENTION

Many phosphine compounds are useful phosphine antistain agents or phosphine antistain agent precursors in a photographic silver halide element and process according to the invention. Combinations of such phosphine compounds are also useful. Selection of an optimum phosphine antistain agent or phosphine antistain agent precursor or combination of such antistain agents or antistain agent precursors will depend upon such factors as the desired image stability, processing conditions, the particular silver halide in the photographic element, the particular silver halide developing agent, the particular binder and other addenda in the photographic element. Examples of useful phosphine antistain agents are represented by the phosphine structures:

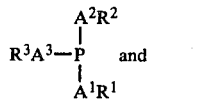

and

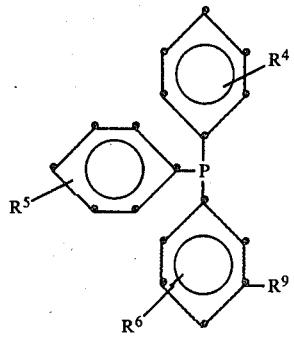

wherein:

$A^1$, $A^2$ and $A^3$ are individually alkylene containing 1 to 4 carbon atoms, such as methylene, ethylene and propylene;

$R^1$, $R^2$ and $R^3$ are individually $SR^7$, $SO_2H$, OH, CN, $SO_2M^1$, COOH, $COOM^1$, $SO_3H$, or $SO_3M^1$;

$R^4$, $R^5$ and $R^6$ are individually hydrogen, $SR^7$, OH, $OR^8$, $SO_2H$, $SO_2M^1$, COOH, $COOM^1$, $SO_3H$, $SO_3M^1$ or CN;

$R^7$ and $R^8$ are individually alkyl, such as alkyl containing 1 to 4 carbon atoms, including methyl, ethyl, propyl and butyl, or aryl containing 6 to 12 carbon atoms, such as phenyl and tolyl;

$R^9$ is hydrogen or $SO_3M^1$; and $M^1$ is a monovalent cation, such as sodium and potassium cations. $M^1$ is preferably a sodium cation.

Examples of specific phosphine antistain agents include:

tri(2-hydroxyethyl)phosphine represented by the structure:

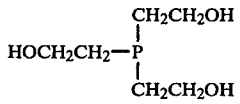

tri(2-carboxyethyl)phosphine represented by the formula:

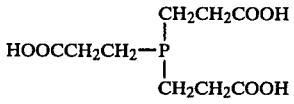

tri(2-cyanoethyl)phosphine represented by the formula:

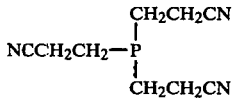

triphenylphosphine represented by the formula:

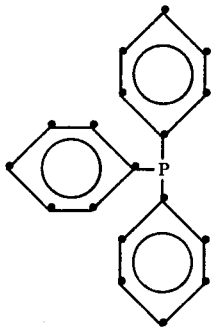

tri(p-hydroxyphenyl)phosphine represented by the formula:

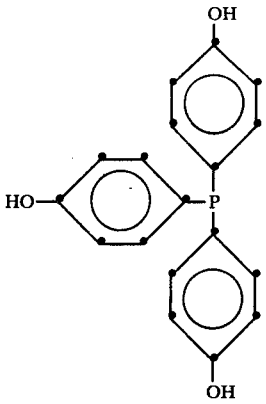

P,P-diphenyl-P-(3-sodiosulphophenyl)phosphine represented by the formula:

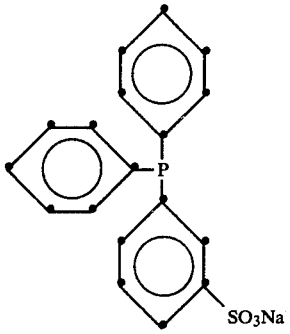

P,P-bis(4-hydroxyphenyl)-P-(3-sodiosulphophenyl)-phosphine represented by the formula:

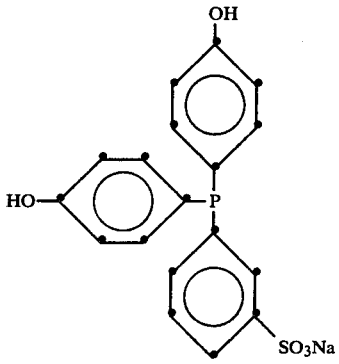

Examples of specific phosphine antistain agent precursors are phosphonium compounds within the following structures:

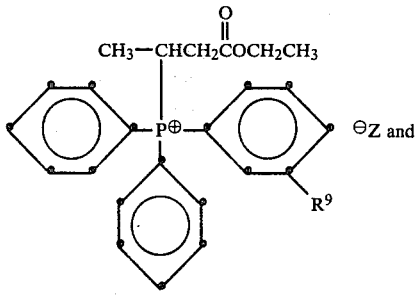

$\oplus X \ominus$
$HOCH_2P(CH_2CH_2COOH)_3$ wherein:

$R^9$ is hydrogen or $SO_3M^1$;

$M^1$ is as defined; and

X and Z are individually acid anions, such as chloride or bromide anions.

Examples of specific phosphonium compounds which are phosphine antistain agent precursors are as follows:

P-(1-ethoxycarbonyl-2-propyl)-P,P,P-triphenylphosphonium chloride represented by the formula:

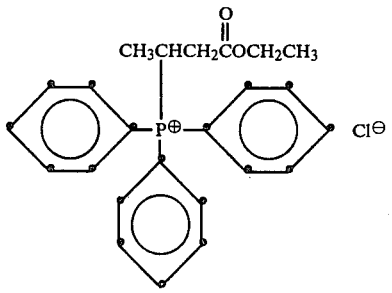

P,P-diphenyl-P-(1-ethoxycarbonyl-2-propyl)-P-(3-sodiosulphophenyl)phosphonium chloride represented by the formula:

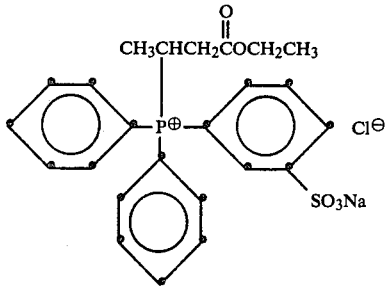

P,P-diphenyl-P-(1-ethoxycarbonyl-2-propyl)-P-(3-sodiosulphophenyl)phosphonium iodide represented by the formula:

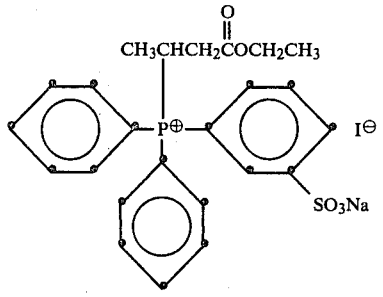

P-(hydroxymethyl)-P,P,P-(2-carboxyethyl)phosphonium chloride represented by the formula:

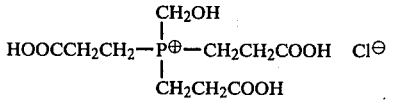

P-(hydroymethyl)-P,P,P-(2-carboxyethyl)phosphonium iodide represented by the formula:

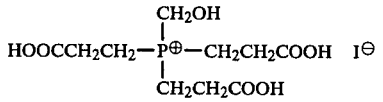

Preparation of the phosphine antistain agents and phosphine antistain agent precursors according to the invention is carried out by methods known in the chemical synthesis art.

The photographic element according to the invention comprises photographic silver halide. Useful photographic silver halides include, for example, silver chloride, silver bromide, silver bromoiodide, silver chlorobromoiodide and mixtures thereof. The grain size of the silver halide ranges from coarse grain to fine grain. The photographic silver halide is prepared by procedures known in the photographic art as described in, for example, *Research Disclosure,* December 1978, Item No. 17643. The photographic element according to the invention, if desired, also contains addenda which do not adversely affect the desired properties of the photographic element, such as antifoggants, tone modifiers, chemical sensitizers, hardeners, matting agents, brighteners, absorbing and filter dyes, development modifiers, spectral sensitizers and coating aids, as described in the above *Research Disclosure* publication. Addenda which are generally useful in phototypesetting photographic elements are especially useful in a photographic element according to the invention.

The photographic element according to the invention contains binders and vehicles, alone or in combination. These binders are useful in one or more layers of the photographic element. Useful vehicles include both naturally occurring substances, such a proteins, for example, gelatin, gelatin derivatives, cellulose derivatives, polysaccharides such as dextran, gum arabic and the like; and synthetic polymeric materials, such as water soluble polyvinyl compounds, like poly(vinylpyrrolidone), acrylamide polymers and the like. The photographic layer and other layers of the elements of the invention, such as overcoat layers, interlayers and subbing layers, alternatively contain, alone or in combination with the described vehicles, other synthetic polymeric vehicle compounds, such as dispersed vinyl compounds, such as in latex form, and particularly those which increase the dimensional stability of the photographic element. Useful binders are also described in *Research Disclosure,* December 1978, Item No. 17643. Selection of an optimum binder depends upon such factors as the processing conditions, the particular components of the photographic element, the particular antistain agent or antistain agent precursor and the desired image. Gelatin and gelatin derivatives are generally very useful binders.

Many supports are useful for a photographic element according to the invention. Useful supports include those that are resistant to adverse changes in structure and do not adversely affect the sensitometric properties of the photographic element during exposure and processing. Examples of useful supports include cellulose ester film, poly(vinyl acetal) film, poly(ethylene terephthalate) film, polycarbonate film and related films and resinous materials, as well as glass, paper, metal and the like. A flexible support is very useful, especially a paper support.

The photographic layer and other layers of a photographic element according to the invention are coated by means of coating procedures known in the photographic art. Such procedures are described in, for example, *Research Disclosure,* December 1978, Item No. 17643.

The antistain agent or antistain agent precursor according to the invention is in the undercoat layer of a photographic element according to the invention. This location enables the antistain agent or antistain agent precursor to reduce or avoid stain formation. This stain is probably due to the undesired formation of silver sulfide after processing. The location of the antistain agent or antistain agent precursor is important to avoid undesired changes in sensitometric properties of the photographic element. When the antistain agent or antistain agent precursor is located in the photographic silver halide containing layer, adverse changes in sensitometric properties are observed, such as reduction in photographic speed and undesired lowering of maximum density of the image upon processing.

A photographic element according to the invention alternatively comprises more than one undercoat layer. For example, an antistain agent or antistain agent precursor is useful in a first undercoat layer and a silver halide developing agent is useful in a second undercoat layer.

Other addenda in the photographic element are useful in one or more layers of the photographic element according to the invention. For example, the photographic element alternatively comprises a silver halide developing agent in the undercoat layer or in one or more of the other layers of the photographic element. It is important that the addenda be in a location which enables the desired interaction during processing. The term "in reactive association" herein means that the addenda, such as the silver halide developing agent, are in such a location enabling such desired interaction.

Many silver halide developing agents are useful in a photographic silver halide element and process according to the invention. Combinations of silver halide developing agents are useful. Useful silver halide developing agents include, for instance, those described in *Research Disclosure,* December 1978, Item No. 17643. Examples of useful silver halide developing agents are phenolic developing agents, such as polyhydroxybenzene developing agents, including hydroquinone and hydroquinone derivatives, ascorbic acid developing agents, such as ascorbic acid, ascorbic acid ketals and ascorbic acid derivatives; reductone developing agents, such as anhydrodihydropiperidinohexosereductone; 3-pyrazolidone developing agents, such as 4-methyl-4-hydroxymethyl-1-phenyl-3-pyrazolidone and 1-phenyl-3-pyrazolidone. A very useful silver halide developing combination is the combination of hydroquinone or a hydroquinone derivative, such as methylhydroquinone, with 1-phenyl-3-pyrazolidone or a related pyrazolidone developing agent.

The optimum concentration of each of the components of the photographic element according to the invention will depend upon such factors as the desired image, processing conditions, particular components in the layers of the photographic element and the particular antistain agent or antistain agent precursor. In a photographic element according to the invention, preferred concentrations are within the following ranges:

(a) photographic silver halide: $10\times10^{-5}$ to $2\times10^{-4}$ moles, especially preferred $1.2\times10^{-4}$ to $1.5\times10^{-4}$ moles; and, (b) antistain agent or antistain agent precursor: $2\times10^{-5}$ to $1.1\times10^{-4}$ moles, especially preferred $3.8\times10^{-5}$ to $7.5\times10^{-5}$ moles; per square decimeter of support. A preferred concentration of photographic silver halide developing agent is within the range of 0.5 to 1.5 moles per silver mole, especially preferred 0.75 to 1.0 mole per silver mole in the photographic element.

An especially useful photographic silver halide element according to the invention comprises a support having thereon:

(a) a photographic silver halide gelatino emulsion layer, (b) an undercoat layer between the emulsion layer and the support, (c) a photographic silver halide developing agent in at least one layer of the element, such as in the undercoat layer, and (d) in the undercoat layer a stain retarding concentration of a phosphine comprising P,P-diphenyl-P-(3-sodiosulphophenyl) phosphine represented by the structure:

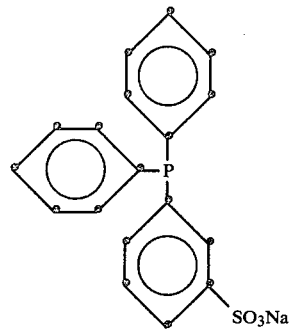

Another especially useful photographic silver halide element according to the invention is a photographic element as described wherein the phosphine antistain agent is replaced by a phosphine antistain agent precursor which is a phosphonium compound comprising P,P-diphenyl-P-(1-ethoxycarbonyl-2-propyl)-P-(3-sodiosulphophenyl)phosphonium chloride represented by the structure:

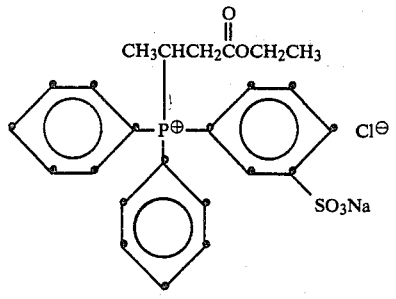

Exposure of a photographic silver halide element according to the invention is by means of forms of energy to which the silver halide is sensitive. The photographic silver halide element is generally imagewise exposed to light. Alternatively, other forms of energy are useful, such as electron beams, X-rays, gamma rays, alpha particles and other nuclear particles. Lasers are also useful. Imagewise exposure of the photographic silver halide element is generally sufficient in time and intensity to provide a developable latent image in the photographic silver halide element.

After exposure of a photographic silver halide element according to the invention, an image is developed and stabilized in the element. Development and stabilization are carried out by processes and compositions described in, for example, *Research Disclosure,* December 1978, Item No. 17643. A very useful process for developing and stabilizing an image in a photographic element according to the invention is known in the photographic art as stabilization processing. In such a process, the photographic silver halide element, after exposure, is associated with an alkaline medium, preferably an aqueous alkaline medium, in the presence of a silver halide developing agent contained in the medium or in the photographic element. The alkaline medium is also known as an activator. Processing formulations and techniques for stabilization processing are illustrated in U.S. Pat. No. 3,220,839; U.S. Pat. No. 3,615,511; U.K. Patent Specification No. 1,258,906; and U.S. Pat. No. 3,647,453. The alkaline medium comprises a base, including, for example, an organic base such as an amine base or inorganic base, such a sodium hydroxide, lithium hydroxide, potassium hydroxide, and other water-soluble metal hydroxides. Combinations of bases are useful. The concentration of base in the medium is sufficient to provide a pH within the range of about 11 to about 14, preferably 13.5 to 13.8. Activation is carried out for a sufficient time to provide desired development.

Following development, the photographic silver halide element is stabilized by means of a stabilizing medium, such as an aqueous solution of a silver halide stabilizer. Many silver halide stabilizers are useful in a stabilizing medium in processing a photographic element according to the invention. Combinations of stabilizers are useful. Useful silver halide stabilizers include, for example, sodium thiosulfate, ammonium thiosulfate and potassium thiosulfate. Stabilizing the developed image in a photographic element according to the invention by means of an aqueous thiosulfate stabilizer solution comprising a silver halide stabilizing concentration of a thiosulfate stabilizing agent, such as sodium thiosulfate or ammonium thiosulfate, is especially useful. An advantage of stabilization by means of such a silver halide stabilizing agent is that no need exists for a separate silver halide fixing step in the process.

An especially useful method of developing and stabilizing a silver image to reduce post-process buildup of stain probably caused by silver sulfide in an exposed photographic element according to the invention comprises the steps of:

(i) activating development of the exposed element by means of an aqueous alkaline activator solution until a developed silver image is produced; and then (ii) stabilizing the resulting image by means of an aqueous thiosulfate stabilizer solution comprising a silver halide stabilizing concentration of ammonium thiosulfate.

Processing is carried out under ambient conditions of pressure and humidity. Atmospheric conditions of pressure, humidity and temperature are preferred for processing. Processing temperature is generally within the range of 18.5° to 29.5° C.

The following examples are included for a further understanding of the invention.

EXAMPLES 1–4

Phosphine Antistain Agent Treatment to Reduce Post-Process (Silver Sulfide Stain) Formation This illustrates the invention.

In each of Examples 1 through 4, the following photographic paper was prepared, exposed imagewise and processed:

| |
|---|
| OVERCOAT LAYER |
| PHOTOGRAPHIC SILVER HALIDE EMULSION LAYER |
| UNDERCOAT LAYER |
| LIGHT-REFLECTING LAYER |
| PAPER SUPPORT |

The light-reflecting layer contains titanium dioxide and gelatin. The photographic silver halide emulsion layer contains 13.6 mg of silver bromoiodide (per square decimeter of support) in a gelatin and polyacrylamide binder, with an antifoggant and spectral sensitizing dye. The undercoat layer contains hydroquinone, methylhydroquinone and 1-phenyl-3-pyrazolidone developing agent, with 5-nitroindazole (antifoggant), sodium formaldehyde bisulfite (hardener), and a surfactant (TX-200®, which consists of sodium octyl phenol poly(etheneoxy) sulfonate and is a trademark of Rohm and Haas Company, USA), and 0.8 mg of N-oleyl-N-methyltaurine per square decimeter of support. The overcoat layer contains in a gelatin binder a matting agent, phloroglucinol, a surfactant (TX-200®) and N-oleyl-N-methyltaurine. This photographic paper was used as a control.

Samples of the photographic silver halide paper were imagewise exposed to light for $10^{-5}$ seconds through a test wedge of graduated density in a commercial sensitometer. This provided a developable latent image in the photographic paper. A commercial automatic processor was used for processing the exposed photographic paper. A Kodak Ektamatic 214K processor, which is a trademark of and available from Eastman Kodak Company, USA, was used for processing at a speed of six feet of photographic paper per minute. The exposed photographic paper was run through an activator solution for 3.3 seconds. The developed photographic paper was then stabilized in a thiosulfate stabilizer solution for 3.4 seconds at 20° to 24° C.

An activator solution which is useful comprises 67.5 grams of potassium hydroxide in sufficient water to make one liter.

A thiosulfate fixing solution which is useful comprises Kodak Rapid Fixing Bath F-7 comprising:

| | | |
|---|---|---|
| Water, about 50° C. | 600. | milliliters |
| Sodium thiosulfate (pentahydrated) | 360.0 | grams |
| Ammonium chloride | 50.0 | grams |
| Sodium sulfite (anhydrous) | 15.0 | grams |
| Acetic acid (28 percent) | 48.0 | milliliters |
| Boric acid, crystals | 7.5 | grams |
| Potassium alum (fine granular, dodecahydrated) | 15.0 | grams |
| Water to make 1 liter | | |

After processing, the freshly processed photographic paper was swabbed with a solution containing $10^{-1}$ moles per liter of the following phosphine compounds in water (solvent). Then the swabbed photographic papers were dried and the minimum density values were observed. The following phosphine compounds were tested in this manner:

| Example | Compound Structure |
|---|---|
| 1 | 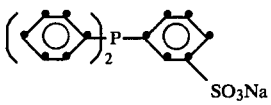 |
| 2 | $(HO_2CCH_2CH_2)_3P$ |
| 3 | $(NCCH_2CH_2)_3P$ |
| 4 | 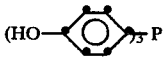 |

After storing the processed photographic papers for seven days at 27° C. at 80 percent relative humidity, the processed minimum density values were observed again. One photographic paper was a control and not given a swabbing treatment. The results are given in the following Table I.

TABLE I

EFFECT OF PHOSPHINE TREATMENT ON PHOTOGRAPHIC SILVER HALIDE ELEMENT

| | D-min Values | |
|---|---|---|
| Example | Fresh | Incubated* |
| Control (none) | 0.1 | 0.58 |
| 1 | 0.1 | 0.1 |
| 2 | 0.1 | 0.2 |
| 3 | 0.1 | 0.2 |
| 4 | 0.1 | 0.1 |

*80° F. (27° C.)/80 percent relative humidity for seven days

The data indicate that the photographic papers containing the phosphine compounds had significantly reduced (silver sulfide) stain formation upon incubation.

EXAMPLE 5

Incorporation of Phosphine Compound in an Undercoat Layer of a Photographic Silver Halide Element A photographic silver halide element was prepared as described in Example 1, with the exception that the paper support was a polyethylene-coated paper. In an undercoat layer beneath the undercoat layer containing developing agent was coated a water solution of the phosphine compound of Example 1 at levels of 0, 16.1 and 21.5 mg per square decimeter (corresponding to levels of 0, 150 and 200 mg per square foot). Samples of the three photographic elements were imagewise exposed and processed as described in Example 1. After processing, the resulting photographic elements were dried under atmospheric conditions without water washing. Then the density measurements were observed by reflected white and blue light. After storing the processed photographic elements for seven days at 24° C. and 80 percent relative humidity, the image densities were observed again. The results are given in the following Table II.

TABLE II

| | Fresh | | Incubated | |
|---|---|---|---|---|
| mg/ft$^2$ | D-max | D-min | D-max | D-min |
| 0 | 1.92 | 0.13 | 1.68 | 0.50 |
| 150 | 1.47 | 0.13 | 1.54 | 0.15 |
| 200 | 1.51 | 0.14 | 1.50 | 0.11 |

This example illustrates that the phosphine compound enables reduction of (silver sulfide) stain formation upon incubation of the photographic element.

The invention has been described in detail with particular reference to preferred embodiments thereof, but it will be understood that variations and modifications can be effected within the spirit and scope of the invention.

What is claimed is:

1. In a photographic silver halide element comprising a support having thereon (a) a photographic silver halide gelatino emulsion layer, (b) an undercoat layer between the emulsion layer and the support, the improvement comprising in the undercoat layer a stain retarding concentration of a phosphine antistain agent or phosphine antistain agent precursor.

2. A photographic silver halide element as in claim 1 also comprising a photographic silver halide developing agent in at least one layer of said element.

3. A photographic silver halide element as in claim 1 also comprising an overcoat layer on the emulsion layer and wherein the overcoat layer also comprises a phosphine antistain agent or phosphine antistain agent precursor.

4. A photographic silver halide element as in claim 1, 2 or 3 wherein said undercoat layer comprises a photographic silver halide developing agent.

5. A photographic silver halide element as in claim 1, 2, or 3 wherein said phosphine antistain agent or phosphine antistain agent precursor is a compound selected from the group represented by (1) the phosphine structures:

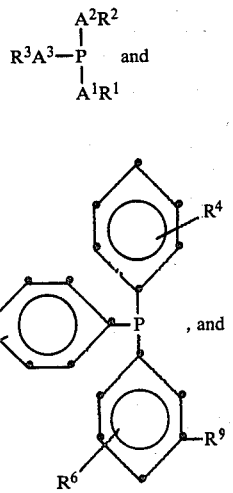

(2) the phosphonium structures:

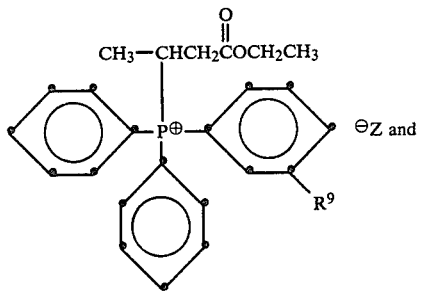

$\oplus X \ominus$
$HOCH_2P(CH_2CH_2COOH)_3$ wherein:

$A^1$, $A^2$ and $A^3$ are individually alkylene containing 1 to 4 carbon atoms;

$R^1$, $R^2$ and $R^3$ are individually $SR^7$, OH, $SO_2H$, $SO_2M^1$, COOH, $COOM^1$, $SO_3H$, $SO_3M^1$ or CN;

$R^4$, $R^5$ and $R^6$ are individually hydrogen, $SR^8$, OH, CN, $OR^8$, $SO_2H$, $SO_2M^1$, COOH, $COOM^1$, $SO_3H$ or $SO_3M^1$;

$R^7$ and $R^8$ are individually alkyl containing 1 to 4 carbon atoms or aryl containing 6 to 12 carbon atoms;

$R^9$ is individually hydrogen or $SO_3M^1$;

$M^1$ is a monovalent cation; and,

X and Z are individually acid anions.

6. A photographic silver halide element as in claim 1, 2 or 3 wherein said antistain agent consists essentially of P,P-diphenyl-P-(3-sodiosulphophenyl)phosphine represented by the structure:

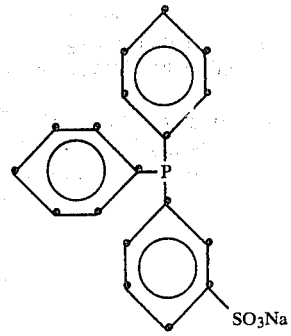

7. A photographic silver halide element as in claim 1, 2 or 3 wherein said antistain agent precursor consists essentially of P,P-diphenyl-P-(1-ethoxycarbonyl)-2-propyl-P-(3-sodiosulphophenyl)-phosphonium chloride represented by the structure:

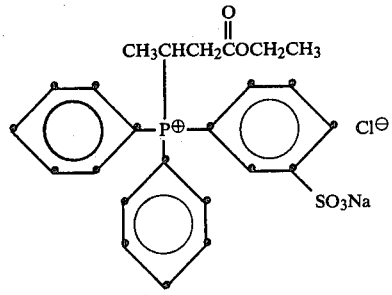

8. A photographic silver halide element as in claim 1, 2 or 3 wherein said stain retarding concentration is within the range of about 54 to about 270 mg of said antistain agent or antistain agent precursor per square decimeter of support.

9. A photographic silver halide element comprising a support having thereon, in sequence:

(a) an undercoat layer comprising
  (i) a photographic silver halide developing agent; and,
  (ii) a stain retarding concentration within the range of about 54 to about 270 mg per square decimeter of support of a phosphine antistain agent consisting essentially of P,P-diphenyl-P-(3-sodiosulphophenyl)phosphine; and
  (iii) a gelatino binder;

(b) a photographic silver halide gelatino emulsion layer; and (c) a gelatino overcoat layer.

10. A method of developing and stabilizing a silver image to reduce post-process buildup of silver sulfide stain in an exposed photographic element as defined in claim 2, said method comprising the steps of:

(i) activating development of the exposed element by means of an aqueous alkaline activator solution until a developed silver image is produced; and then (ii) stabilizing the resulting image by means of an aqueous thiosulfate stabilizer solution comprising a silver halide stabilizing concentration of a thiosulfate stabilizing agent.

11. A method of developing and stabilizing a silver image to reduce post-process buildup of silver sulfide stain in an exposed photographic element comprising a support having thereon, in sequence:

(a) an undercoat layer comprising (i) a photographic silver halide developing agent; and (ii) a stain retarding concentration within the range of about 54 to about 270 mg per square decimeter of support of a phosphine antistain agent consisting essentially of P,P-diphenyl-P-(3-sodiosulphophenyl) phosphine; and (iii) a gelatino binder;

(b) a photographic silver halide gelatino emulsion layer; and (c) a gelatino overcoat layer, said method comprising the steps of:

(i) activating development of the exposed element by means of an aqueous alkaline activator solution until a developed silver image is produced; then (ii) stabilizing the resulting image by means of an aqueous thiosulfate stabilizer solution comprising a silver halide stabilizing concentration of ammonium thiosulfate.

12. In an exposed and thiosulfate stabilization processed photographic silver halide element comprising a support having thereon (a) a gelatino emulsion layer comprising a developed and thiosulfate stabilized silver image; and (b) an undercoat layer between the emulsion layer and the support, the improvement comprising in the undercoat layer, a silver sulfide stain retarding concentration of a phosphine antistain agent or phosphine antistain agent precursor.

13. An exposed and thiosulfate stabilization processed photographic silver halide element as in claim 12 also comprising an overcoat layer on the emulsion layer and wherein the overcoat layer also comprises a phosphine antistain agent or phosphine antistain agent precursor.

14. An exposed and thiosulfate stabilization processed photographic silver halide element as in claim 12 wherein said antistain agent consists essentially of P,P-diphenyl-P-(3-sodiosulphophenyl)-phosphine.

15. An exposed and thiosulfate stabilization processed photographic silver halide element comprising a support having thereon, in sequence:

(a) an undercoat layer comprising a stain retarding concentration within the range of about 54 to about 270 mg per square decimeter of support of a phosphine antistain agent consisting essentially of P,P-diphenyl-P-(3-sodiosulphophenyl)phosphine in a gelatino binder;

(b) a gelatino emulsion layer comprising a developed and thiosulfate stabilized silver image; and, (c) a gelatino overcoat layer.

* * * * *